US006753645B2

(12) United States Patent
Haruki et al.

(10) Patent No.: US 6,753,645 B2
(45) Date of Patent: Jun. 22, 2004

(54) PLASMA DISPLAY PANEL

(75) Inventors: Shigeo Haruki, Kyoto (JP); Utaro Miyagawa, Kyoto (JP); Shigeyuki Okumura, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 290 days.

(21) Appl. No.: 09/732,804

(22) Filed: Dec. 8, 2000

(65) Prior Publication Data

US 2001/0003410 A1 Jun. 14, 2001

(30) Foreign Application Priority Data

Dec. 14, 1999 (JP) ..... 11-354679

(51) Int. Cl.[7] ..... H01J 63/04

(52) U.S. Cl. ..... 313/486; 313/582; 313/584; 252/301.6 F; 252/301.4 R

(58) Field of Search ..... 313/582, 583, 313/584, 585, 586, 587, 483, 484, 486; 362/84; 252/301.6 F, 301.4 R

(56) References Cited

U.S. PATENT DOCUMENTS 4,559,469 A * 12/1985 Welker et al. ..... 313/468
5,136,207 A * 8/1992 Miyake et al. ..... 313/582
5,701,054 A * 12/1997 Park et al. ..... 313/467
6,004,481 A * 12/1999 Rao ..... 252/301.4 R
6,051,368 A * 4/2000 Masuko et al. ..... 430/288.1
6,168,892 B1 * 1/2001 Ohara et al. ..... 430/45
6,388,644 B1 * 5/2002 De Zwart et al. ..... 345/60
6,399,287 B1 * 6/2002 Park et al. ..... 430/321

FOREIGN PATENT DOCUMENTS

| | | |
|---|---|---|
| JP | 52-133091 | 11/1977 |
| JP | 7-3261 | 1/1995 |
| JP | 11-86735 | 3/1999 |

* cited by examiner

*Primary Examiner*—David V. Bruce
*Assistant Examiner*—Beth Gemmell
(74) *Attorney, Agent, or Firm*—Merchant & Gould P.C.

(57) ABSTRACT

A plasma display panel comprising plural kinds of phosphor layers emitting different colors of fluorescent light, at least one kind of the phosphor layer being formed of a mixed phosphor obtained by mixing a phosphor having a surface potential with a negative polarity and a phosphor having a surface potential with a positive polarity. By using the mixed phosphor, the negative polarity of the surface potential is changed to the positive polarity, thereby reducing the discharge error and discharge variation, and improving the quality of display.

2 Claims, 10 Drawing Sheets

PLASMA DISPLAY PANEL

BACKGROUND OF THE INVENTION

1. Field of the Invention

The present invention relates to a plasma display panel using an emission from phosphors excited by vacuum ultraviolet rays generated by a rare gas discharge.

2. Description of the Related Art

As shown in FIG. 9, in an AC plasma display panel, a front substrate 21 and a back substrate 22 are positioned opposing each other with a discharge space 23 interposed therebetween. On the front substrate 21, pairs of stripe-shaped scanning electrodes 26 and sustain electrodes (not shown) are arranged so as to extend in the direction parallel to a paper surface. They are covered with a dielectric layer 24 and a protective layer 25. On the back substrate 22, stripe-shaped data electrodes 27 are arranged in the direction perpendicular to the scanning electrodes 26 and sustain electrodes. Stripe-shaped separation walls 28 are provided between the data electrodes 27 to form discharge cells 29 together with the front substrate 21 and the back substrate 22. Furthermore, phosphors 30 are provided on the data electrodes 27 and side faces of the separation walls 28. Each phosphor 30 is provided on each discharge cell 29 with respect to each color, and thus red, green, and blue phosphors are arranged successively.

In the plasma display panel, the phosphors 30 applied to the display cell are excited by 147 nm-wave length vacuum ultraviolet rays generated by a rare gas discharge. The emitted ray is used for color display. A well known example of materials for the phosphor 30 includes a red phosphor such as an europium activated yttrium, gadolinium borate phosphor, (Y, Gd) $BO_3$: Eu, a green phosphor such as a manganese activated zinc silicate phosphor, $Zn_2SiO_4$: Mn, a blue phosphor such as an europium activated barium magnesium aluminate phosphor, $BaMgAl_{10}O_{17}$: Eu, and the like.

Conventionally, the $Zn_2SiO_4$: Mn phosphor that generally has been used for a green phosphor has a surface potential with a negative polarity. FIG. 10 shows a blow-off charging amount of various phosphors. As is shown in FIG. 10, only $Zn_2SiO_4$: Mn is charged negatively. It is estimated that variation of discharge characteristics in the plasma display panel is dependent upon this negative charge.

The present inventors have found that when the voltage is applied to a surface of a phosphor using such a phosphor for display, discharge variation or discharge error, i.e., failure of generating discharge, occurs more frequently as compared with the phosphors charged positively. This phenomenon deteriorates the quality of the display, or requires an increase in set driving voltage in order to raise the voltage until complete lighting is obtained so as to maintain the high quality.

The charging amount of the phosphor is a physical property value that is determined depending upon kinds of materials. Therefore, it is difficult to modify this physical property value. One method for modifying the charging amount, suggested in JP 11(1999)-86735A, is that a film for modifying the polarity be laminated on the phosphor layer. However, there are problems in that the number of steps is increased due to laminating a film of non-emitting materials, or luminance is lowered.

Furthermore, an example of green phosphor emitting by excitation by vacuum ultraviolet rays includes manganese activated barium magnesium aluminate, $BaAl_{12}O_{19}$: Mn phosphor. The surface potential of this phosphor is charged with a positive polarity and the discharge is stable. However, this phosphor has low luminance and is deteriorated significantly over time during the operation of the panel. Thus, this is not suitable for practical use.

Another example of the green phosphor is terbium activated yttrium borate, $YBO_3$: Tb phosphor. This phosphor has the surface potential with a positive polarity, but has the color purity inferior to a copper, gold activated zinc sulfide phosphor, ZnS:Cu, Au (JEDEC registered No. P-22), and the region for reproducing color becomes narrower. Thus, the quality of the display is deteriorated.

SUMMARY OF THE INVENTION

It is an object of the present invention to provide a plasma display panel capable of stabilizing the discharge property and realizing a high luminance and long lifetime, and having the same or higher degree of the color purity as compared with that of CRT.

The present inventors have found that the use of a mixed phosphor obtained by mixing a phosphor having a surface potential with a negative polarity and a phosphor having a surface potential with a positive polarity for the phosphor screen makes it possible to stabilize the discharge without deteriorating the luminance.

Therefore, a plasma display panel of the present invention includes plural kinds of phosphor layers emitting different colors of fluorescent light. At least one kind of phosphor layer is formed of a mixed phosphor obtained by mixing a phosphor having a surface potential with a negative polarity and a phosphor having the surface potential with a positive polarity.

With such a configuration, the surface potential of the phosphor is changed from the negative polarity to the positive polarity, so as to reduce the discharge variation or discharge error in the plasma display panel. Thus, it is possible to display a picture stably.

Furthermore, the plasma display panel of the present invention includes a pair substrates positioned opposing each other with a discharge space provided therebetween where at least front substrate is transparent, a separation wall disposed on at least one substrate so as to divide the discharge space into several parts, a group of electrodes arranged on the substrate so that discharge is performed in the discharge spaces divided by the separation walls, and phosphor layers emitting light by the discharge. In the plasma display of the present invention, the phosphor layers include plural kinds of phosphor layers emitting different colors of fluorescent light, at least one kind of the phosphor layer being formed by using a mixed phosphor obtained by mixing a phosphor having a surface potential with a negative polarity and a phosphor having a surface potential with a positive polarity.

In either of the above-mentioned configurations, it is possible to form a mixed green phosphor layer formed of a mixed phosphor obtained by mixing a manganese activated zinc silicate phosphor represented by the general formula, $Zn_2SiO_4$: Mn and having a surface potential with a negative polarity and a terbium activated rare earth borate green phosphor represented by the general formula, $ReBO_3$:Tb, wherein Re denotes one rare earth element or a solid solution of plural kinds of rare earth elements selected from the group consisting of Sc, Y, La, Ce and Gd, having a surface potential with a positive polarity.

It is preferable in this configuration that the mixing ratio of the terbium activated rare earth borate green phosphor to the whole composition in the mixed phosphor is 10 to 75 weight %.

DETAILED DESCRIPTION OF THE INVENTION

Hereinafter, the plasma display panel according to one embodiment of the present invention will be described with reference to FIGS. 1 to 8.

Figure 1:
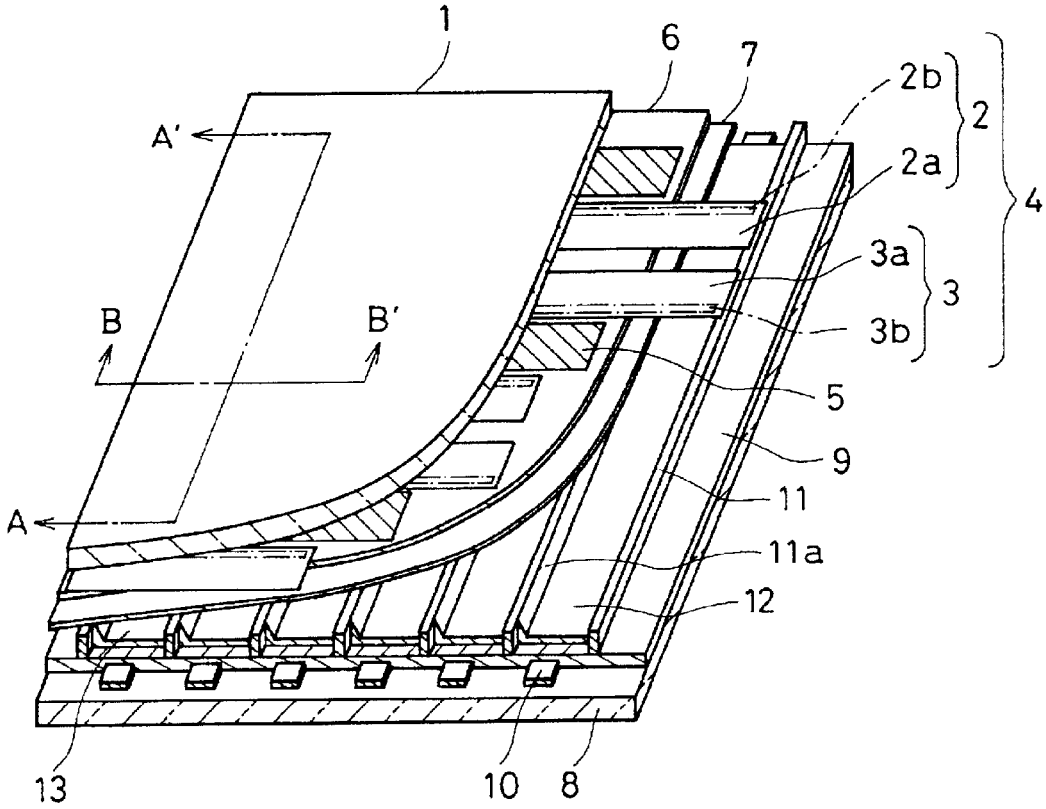
FIG. 1 is a partially cutaway perspective view showing a configuration of a panel of a plasma display panel according to one embodiment of the present invention.
Figure 2:
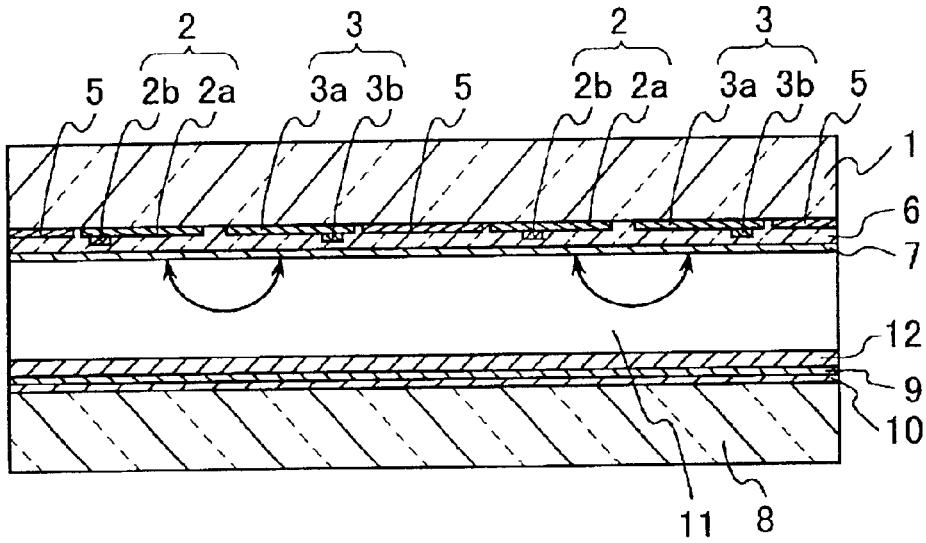
FIG. 2 is a cross sectional view of a part along line A–A' of FIG. 1.
Figure 3:
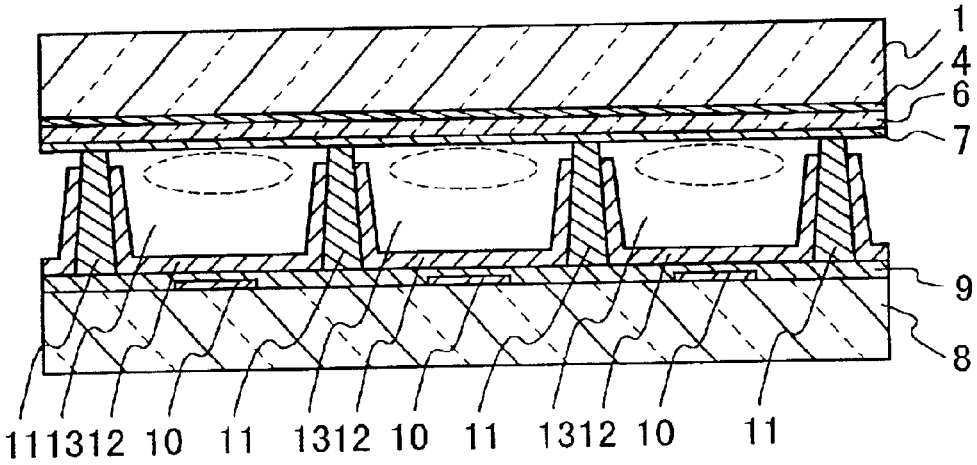
FIG. 3 is a cross sectional view of a part along line B–B' of FIG. 1.

FIG. 1 shows one example of the configuration of a plasma display panel according to one embodiment of the present invention. FIG. 2 is a cross sectional view of a part along line A–A' of FIG. 1. FIG. 3 is a cross sectional view of a part along line B–B' of FIG. 1. As shown in these figures, a plurality of pairs of stripe-shaped display electrodes 4 including scanning electrodes 2 and a sustain electrodes 3 are provided on a transparent front substrate 1 such as a glass substrate. A shield layer 5 is provided between neighboring display electrodes 4 on the substrate 1. These scanning electrode 2 and sustain electrode 3 respectively include transparent electrodes 2*a* and 3*a* and bus-bars 2*b* and 3*b*. The bus-bars 2*b* and 3*b* are made of silver, etc. and electrically connected to the transparent electrodes 2*a* and 3*a*. Furthermore, on the front substrate 1, a dielectric layer 6 is provided so as to cover a plurality of pairs of electrode groups. On the dielectric layer 6, a protective layer 7 is provided.

On a back substrate 8 arranged opposing the front substrate 1, a plurality of stripe-shaped data electrodes 10, which are covered with an insulating layer 9 and extend in the direction perpendicular to the display electrode 4, are provided. On the insulating layer 9 between the data electrodes 10, a plurality of stripe-shaped separation walls 11 are provided in parallel to the data electrodes 10. On the side face 11*a* between the separation walls 11 and the surface of the insulating layer 9, a phosphor layer 12 is provided.

The front substrate 1 and the back substrate 8 are arranged opposing each other with a small discharge space interposed therebetween so that the scanning electrodes 2 and sustain electrodes 3 are orthogonal to the data electrodes 10. The peripheral portions of both substrates are sealed. Any one of gases selected from helium, neon, argon and xenon, or mixed gas is sealed in the discharge space as a discharge gas. Furthermore, the discharge space is divided into a plurality of spaces by the separation walls 11, and a plurality of discharge cells 13 corresponding to the intersection between the display electrode 4 and data electrode 10 are formed. In each discharge cell 13, one color selected from red, green and blue phosphor layer 12 is disposed one by one.

Figure 4:
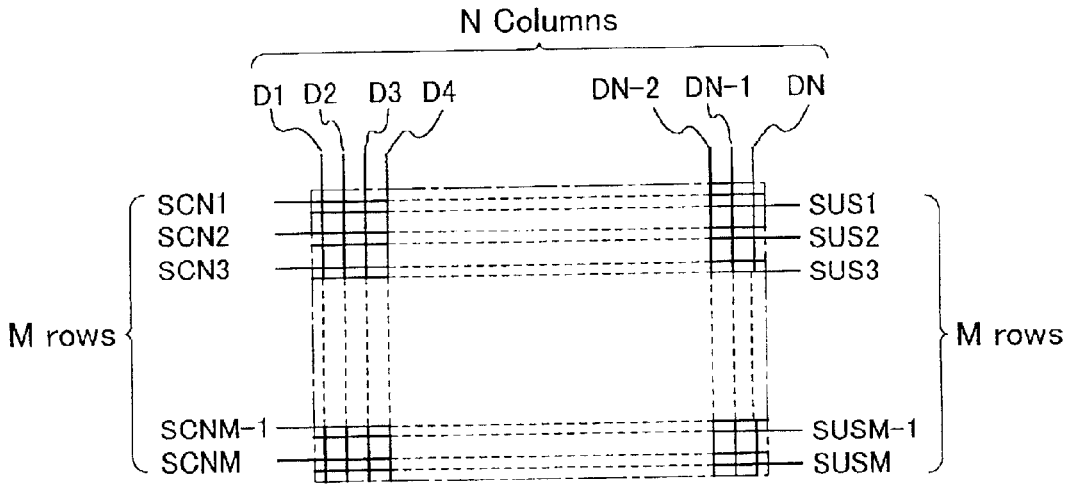
FIG. 4 is a plan view to explain the arrangement of electrodes in the panel of FIG. 1.
Figure 5:
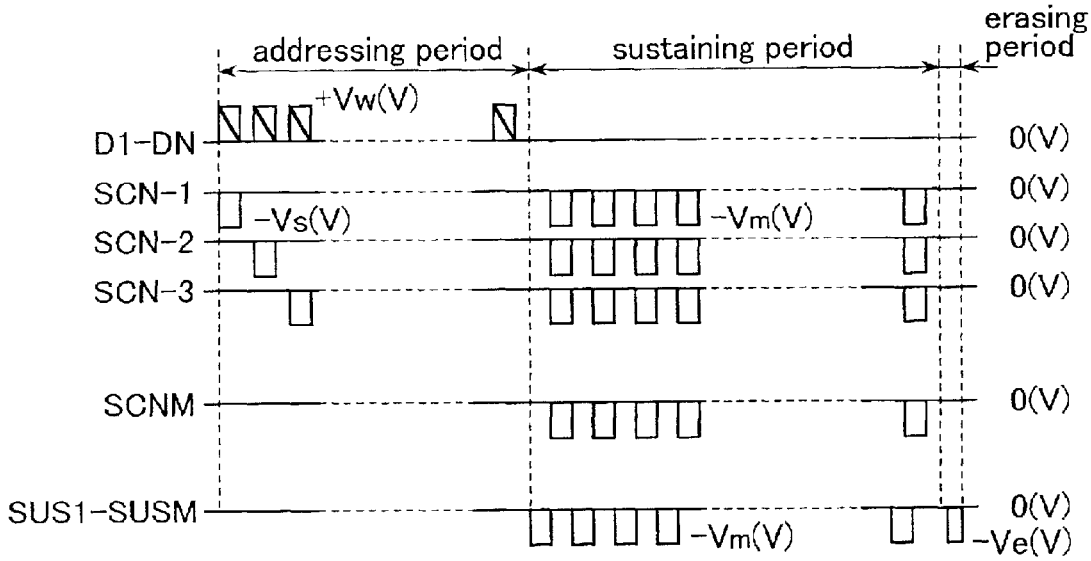
FIG. 5 is a signal waveform showing one example of a method of driving the plasma display panel of FIG. 1.

Next, the operation of the above-mentioned panel is described. As shown in FIG. 4, the electrodes of this panel are arranged in a matrix with M (rows)×N (columns). In the row direction, M rows of scanning electrodes SCN1 to SCNM and M rows of sustain electrodes SUS1 to SUSM are arranged. In the column direction, N columns of data electrodes D1 to DN are arranged. FIG. 5 shows a timing chart showing an example of a method of driving the AC plasma display apparatus using this panel.

As shown in FIGS. 4 and 5, in an addressing period, all the sustain electrodes SUS1 to SUSM are maintained at a voltage 0 (V). A positive write pulse voltage of +Vw (V) is applied to predetermined data electrodes D1 to DN corresponding to discharge cells to be displayed in the first row, and a negative scanning pulse voltage of −Vs (V) is applied to the scanning electrode SCN1 of the first column, respectively. This causes a write discharge at the intersection of the predetermined data electrodes D1 to DN and the scanning electrode SCN1 in the first row.

Next, a positive write pulse voltage of +Vw (V) is applied to predetermined data electrodes D1 to DN corresponding to discharge cells to be displayed in the second row, and a negative scanning pulse voltage of −Vs (V) is applied to the scanning electrode SCN2 of the second column, respectively. This causes a write discharge at the intersection of the predetermined data electrodes D1 to DN and the scanning electrode SCN2 in the second row.

The same operations are carried out successively. Finally, a positive write pulse voltage of +Vw (V) is applied to predetermined data electrodes D1 to DN corresponding to discharge cells to be displayed in the M-th row, and a negative scanning pulse voltage of −Vs (V) is applied to the scanning electrode SCNM in the M-th column, respectively. This causes a write discharge at the intersection of the predetermined data electrodes D1 to DN and the scanning electrode SCNM in the M-th row.

In a sustain period following the addressing period, all the scanning electrode SCN1 to SCNM are maintained at a voltage 0 (V), and at the same time, a negative sustain pulse voltage −Vm (V) is applied to all the sustain electrodes SUS1 to SUSM. This causes a sustain discharge between the scanning electrodes SCN1 to SCNM and the sustain electrodes SUS1 to SUSM at the intersection where the write discharge occurred. Then, a negative sustain pulse voltage of −Vm (V) is applied to all the scanning electrode SCN1 to SCNM and all the sustain electrodes SUS1 to SUSM alternately. Thereby, sustain discharges occur in the discharge cells to be displayed successively. Light emissions caused by the sustain discharges are used for panel display.

In the subsequent erase period, all the scanning electrodes SCN1 to SCNM are maintained at a voltage 0 (V), and at the same time, an erase pulse voltage of −Ve (V) is applied to all the sustain electrodes SUS1 to SUSM. This causes an erase discharge to terminate the sustain discharges.

Through the above-mentioned operations, one picture is displayed in AC plasma display panel.

In the plasma display panel of the present invention, a mixed phosphor made by mixing phosphors, each having different polarities of the surface potential, is used as a phosphor layer 12. Namely, by mixing a phosphor having a positive surface potential with a phosphor having a negative surface potential, the surface potential of the mixed phosphor can be made to have a positive polarity.

As mentioned above, among the phosphors generally used for the conventional plasma display panel, only the green phosphor $Zn_2SiO_4$: Mn is charged negatively. The red phosphor (Y, Gd)$BO_3$: Eu and the blue phosphor $BaMgAl_{10}O_{17}$: Eu are charged positively. On the other hand, a green phosphor $YBO_3$: Tb is charged positively. Therefore, it is anticipated that in the phosphor formed by mixing $Zn_2SiO_4$: Mn with $YBO_3$: Tb, as the mixing ratio of the $YBO_3$: Tb is increased, the charging amount is shifted from the negative polarity to the positive polarity. However, it is also anticipated that mixing the phosphors may cause a deterioration of the color purity. Therefore, mixing is not always better method.

Figure 6:
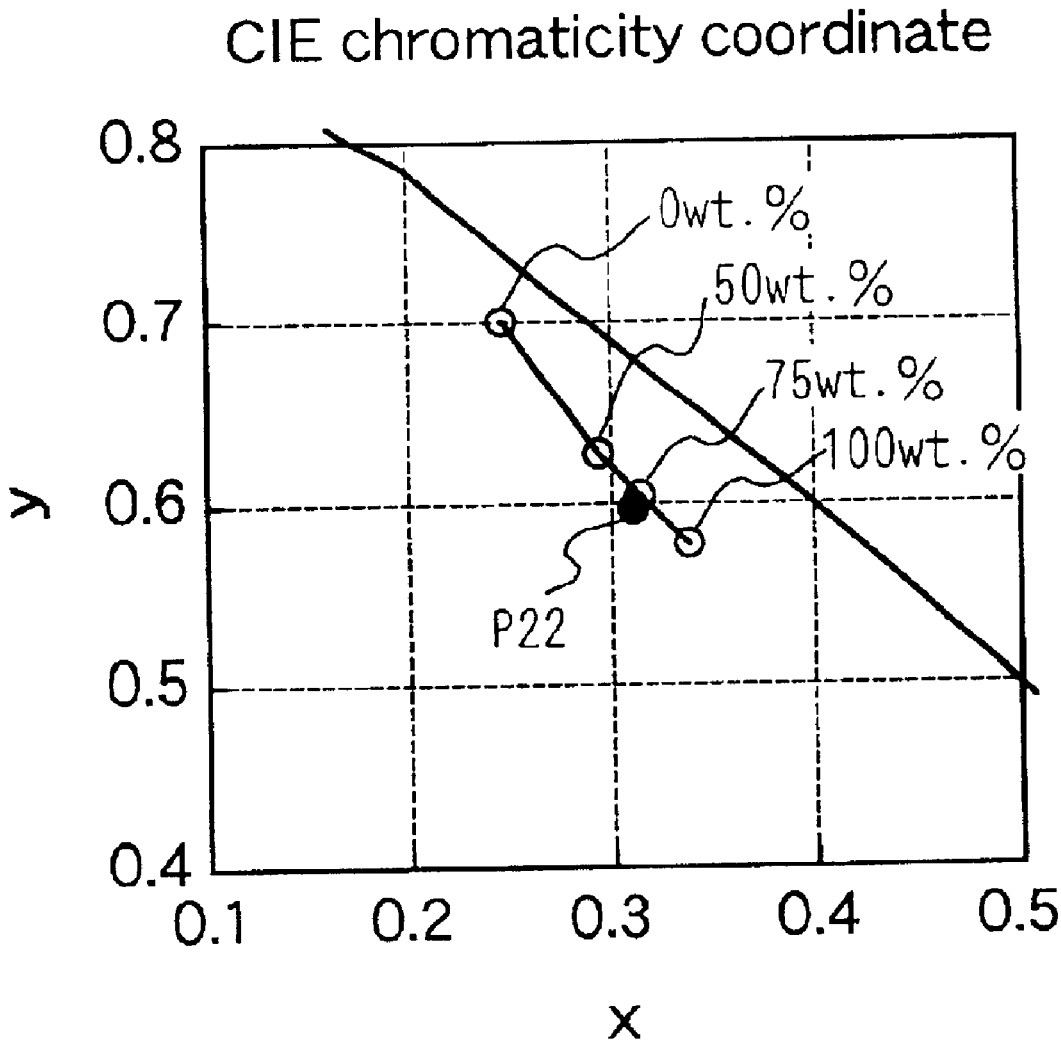
FIG. 6 is a graph showing the characteristics where the chromaticity of mixed phosphors and CRT phosphor (P-22) are shown on CIE chromaticity coordinate.

FIG. 6 shows a relationship between the mixing ratio of $YBO_3$: Tb to $Zn_2SiO_4$: Mn and change in the chromaticity. Herein, mixing ratio refers to a ratio of the mixing phosphor to whole composition of the mixed phosphor. It is shown that when the mixing ratio of $YBO_3$: Tb is less than 75 weight %, the color purity is at a level superior to the chromaticity of P22 phosphor ZnS: Cu, Au (x=0.310, y=0.595) used for CRT.

Thus, according to the present invention, it is possible to obtain a stable discharge property while a sufficient level of color purity is secured and the surface potential is changed into the positive polarity.

Next, one example of the method for producing the phosphor layer is described. The phosphor layer can be formed by a usual screen printing method. FIG. 7 shows an outline of the method for producing the phosphor layer by the screen printing method. In FIG. 7, electrodes, etc. are not shown.

Figure 7A:
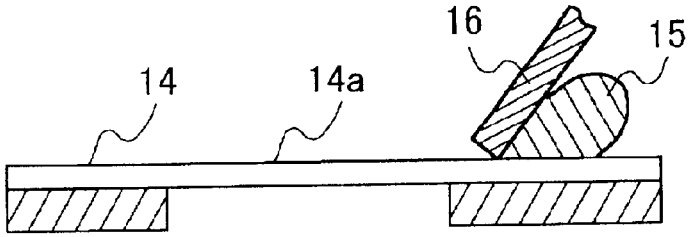
FIGS. 7A–7E are schematic cross sectional views to explain a process of making the phosphor layer of the plasma display panel according to the present invention.

First, as shown in FIG. 7A, on the back substrate on which the separation walls are formed, a mask 14 (for example, a mesh screen, a metal mask, or the like), provided with a pattern 14*a*, is set. Then, a phosphor paste 15 is dropped onto the mask 14 and attached within the separation wall by using a squeegee 16. This phosphor paste 15 is a mixture including a phosphor and vehicle. The mixing ratio is varied depending upon the particle diameter of the phosphor, types of screen, and kinds of resin. An example of the generally used resin includes ethyl cellulose resins or acrylic resins. An example of the generally used solvent includes terpineol and BCA (butyl carbitol acetate). In the Examples, ethyl cellulose was used for the resin and terpineol was used for the solvent.

Figure 7B:
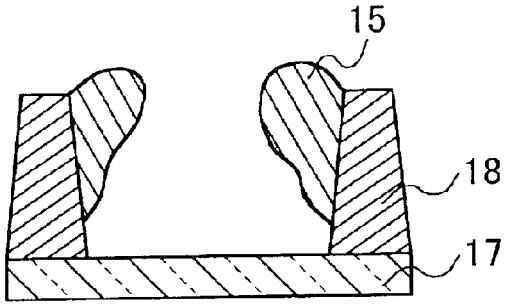
Figure 7C:
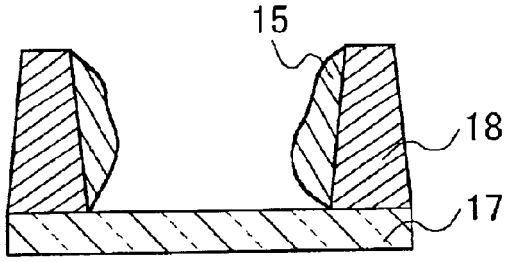
Figure 7D:
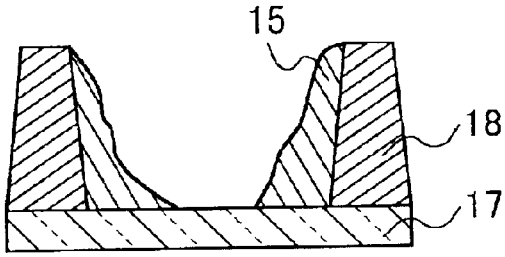
Figure 7E:
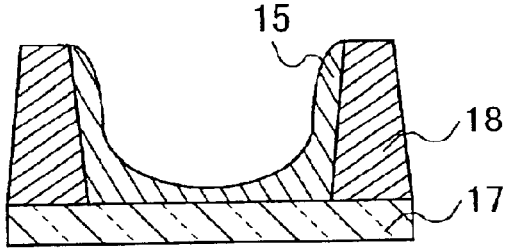

Furthermore, FIGS. 7B to 7E show an outline of the state in which phosphor paste 15 is filled in a separation wall 18. First, as shown in FIG. 7B, the phosphor paste 15 discharged from the mask 14 is transferred onto the side face of the separation wall 18 provided on the substrate 17. Next, as shown in FIG. 7C, the phosphor paste 15 drops by its own weight along the separation wall 18. Thereafter, as shown in FIG. 7D, the phosphor paste 15 is spread over the separation wall by its own weight and the surface tension of the phosphor paste 15 so that the phosphor paste 15 can make a uniform film. Finally, as shown in FIG. 7E, the phosphor paste assumes a predetermined shape by the balanced surface tension.

The method for producing the phosphor layer is not necessary limited to the screen printing method, and other methods can be employed. For example, an ink jet method, a spray method, a transfer method, and the like, can be employed.

Hereinafter, the present invention will be described with reference to Examples.

EXAMPLE 1

$Zn_2SiO_4$: Mn and $YBO_3$: Tb as green phosphors are mixed so that the ratio of $YBO_3$: Tb becomes 50 weight % with respect to the whole composition so as to form a mixed phosphor. This mixed phosphor was used as a green component to form a plasma display panel. Table 1 shows a luminescence property of the phosphors used for the mixed phosphor in this Example.

TABLE 1

| | $Zn_2SiO_4$:Mn | $YBO_3$:Tb |
|---|---|---|
| Relative luminance | 100 | 100 |
| CIE chromaticity (x/y) | 0.244/0.698 | 0.334/0.578 |

At this time, a conventional plasma display panel including $Zn_2SiO_4$: Mn as the green component was prepared for comparison in the same manner except that the phosphor material was changed. Table 2 shows a luminescence property of the plasma display panel of the present invention and prior art.

TABLE 2

| | Example PDP | Conventional PDP |
|---|---|---|
| Relative luminance | 100 | 100 |
| CIE chromaticity (x/y) | 0.293/0.632 | 0.244/0.698 |
| Discharge error (in 100) | 3 | 25 |
| Discharge variation (relative value) | 0.1 | 1.0 |

In general, the discharge stability is evaluated based on the following equation.

$$Nt/N0=\exp(-(t-tf)/ts)$$

In this equation, Nt denotes a number of times in which discharge fails to occur (i.e., discharge error) during the period of time t; NO denotes a number of times counting the delay of discharge; tf denotes a delay in formation, and ts denotes a discharge variation. In this Example, the discharge stability was evaluated based on the number of times of discharge errors Nt and discharge variation ts. As ts, i.e. a parameter representing the discharge variation, is smaller, the discharge is reduced. A large value of the discharge variation means that discharge does not start in a constant time with respect to the input, thus significantly deteriorating the display quality. For the evaluation of the discharge error, Nt, i.e. the number of times in which discharge fails to occur when pulse is input 100 times (i.e. the number of times of discharge errors) was counted. Furthermore, in order to evaluate the discharge variation ts, ts in the above equation was relatively compared.

As is shown in Table 2, in the evaluation of the discharge property of the plasma display panel of this Example, the discharge error can be reduced by about 90% and the discharge variation can be reduced by 90% as compared with the conventional apparatus.

The material for the phosphors is not necessarily limited to the $YBO_3$: Tb phosphor. The same effect can be obtained by using a phosphor having the surface potential with a positive polarity. For example, a terbium activated rare earth borate green phosphor represented by the general formula, $ReBO_3$: Tb (Re denotes one of rare earth element or a solid solution of plural kinds of rare earth elements selected from the group consisting of Sc, Y, La, Ce and Gd) has a positive polarity of surface potential. A mixed phosphor using Re other than Y in the above general formula also produced the same effect when the mixed phosphor was used for the plasma display panel of the present invention.

In the CIE chromaticity coordinates (x/y), the luminescent color of the phosphor of the present example is expressed by x=0.293 and y=0.632, while P-22 phosphors used for CRT, by x=0.310 and y=0.595. This result shows the color purity of the phosphor of the present example is more excellent than that of P-22 phosphor.

EXAMPLE 2

Figure 8:
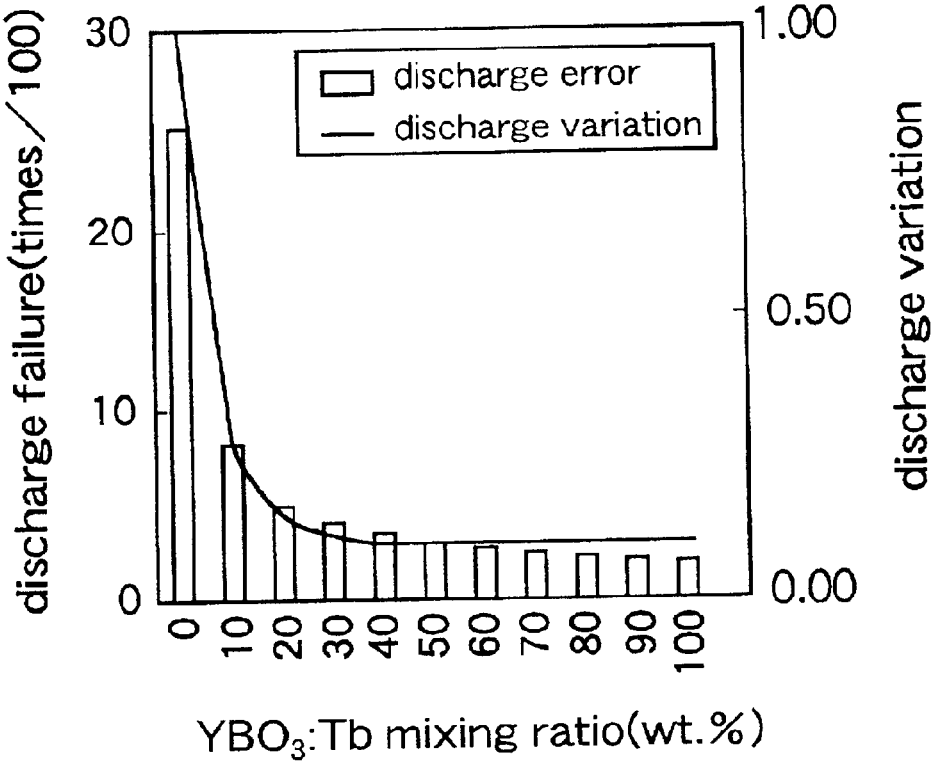
FIG. 8 is a graph showing relationships between mixing ratio of $Zn_2SiO_4$:Mn to $YBO_3$: Tb and discharge error and discharge variation, respectively.
Figure 9:
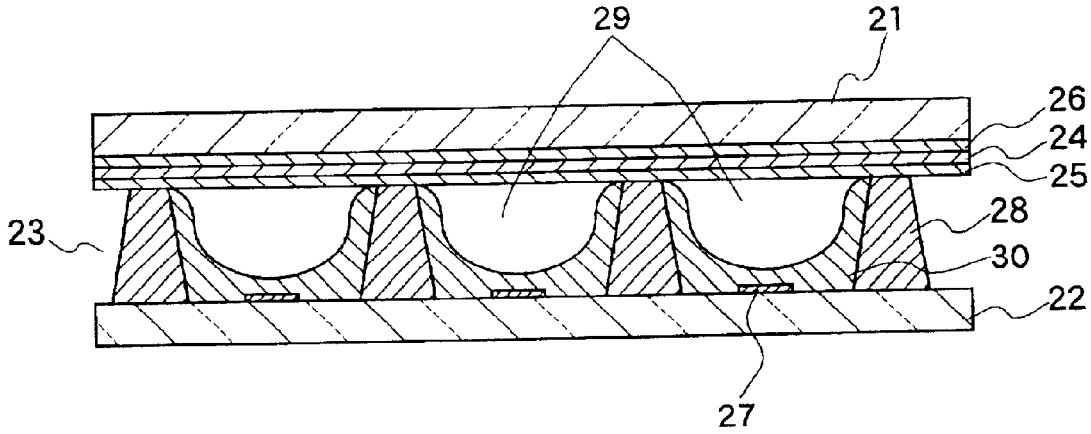
FIG. 9 PRIOR ART
FIG. 9 is a cross sectional view showing one example of a configuration of a conventional plasma display panel.
Figure 10:
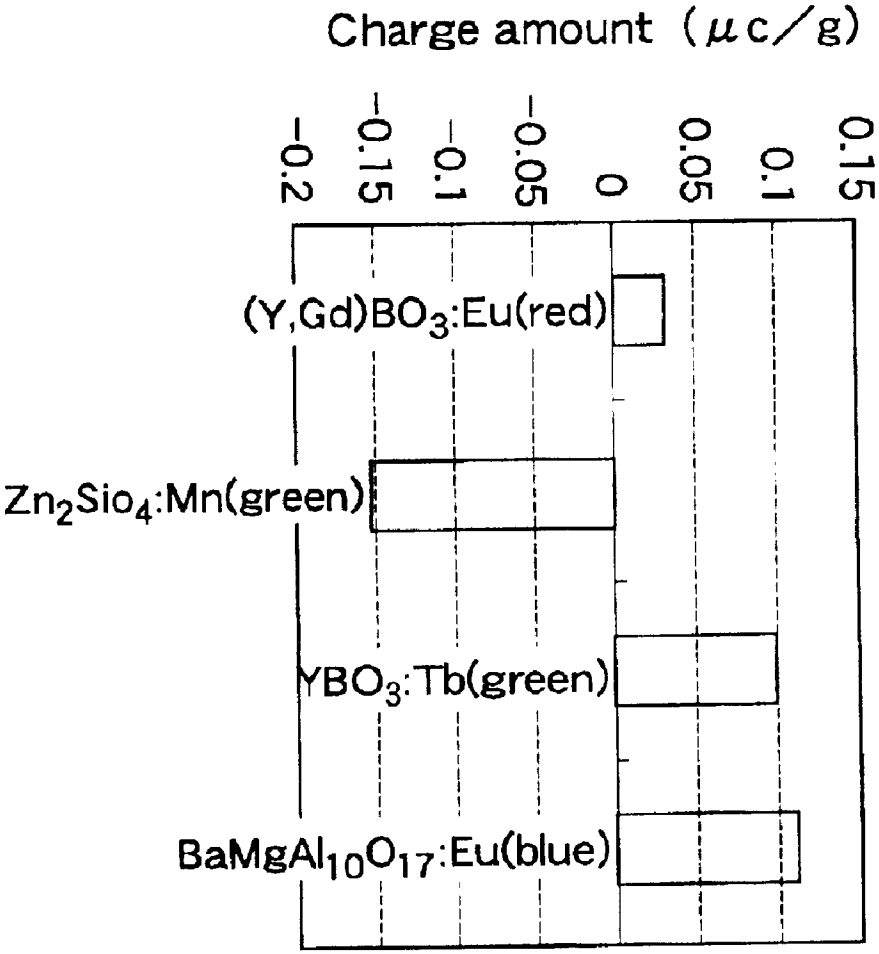
FIG. 10 PRIOR ART
FIG. 10 is a view showing the characteristic of the charging amount of blow off discharge of various phosphors.

$Zn_2SiO_4$: Mn and $YBO_3$: Tb as green phosphors are mixed with changes in the ratio of $YBO_3$: Tb to form a mixed phosphor. This mixed phosphor was used for the above-mentioned plasma display panel and the discharge error and discharge variation were evaluated. FIG. 8 shows a relationship between the mixing ratio (wt. %) of $YBO_3$: Tb and discharge error or discharge variation. The mixed ratio refers to the ratio of $YBO_3$: Tb to the whole composition.

As is shown in FIG. 8, as the mixing amount of $YBO_3$: Tb was increased, the discharge error and discharge variation were reduced, thus enhancing the discharge stability. In particular, at the point where the mixing ratio of the $YBO_3$: Tb is 10 weight %, the effect was significantly exhibited, and when the mixing ratio is more than 10 weight %, the effect was converged. Thus, 10 weight % or more for the mixing ratio can improve the quality of display sufficiently. However, when $YBO_3$: Tb was used, as shown in FIG. 6, when the mixing ratio is 75 weight % or more, the color purity is inferior to that of CRT. Therefore, in this case, the mixing ratio of $YBO_3$:Tb is desired to be 75 weight % or less.

EXAMPLE 3

A mixed phosphor was prepared as a phosphor of the present invention by mixing $Zn_2SiO_4$:Mn and $YBO_3$:Tb so that the ratio of $YBO_3$:Tb became 50 weight % with respect to the whole composition. On the other hand, a $Zn_2SiO_4$:Mn green phosphor and a $BaAl_{12}O_{19}$:Mn green phosphor were prepared as a conventional phosphor. Plasma display panels were produced by using the above-mentioned phosphors as a green component, respectively. All the apparatus were produced by using the same materials and process other than the phosphor. The lifetime test was carried out in these plasma display panel and the deterioration of the phosphor over time was examined. Table 3 shows the life time property. Values in Table 3 are represented by the relative luminance when the luminance of $Zn_2SiO_4$:Mn at the initial operation was defined as 100. The values in parentheses are the deterioration rate.

TABLE 3

| | | At initial operation | After 6000 hrs. operation |
|---|---|---|---|
| Prior art | $Zn_2SiO_4$:Mn | 100 | 85 (85) |
| Prior art | $BaAl_{12}O_{19}$:Mn | 80 | 60 (75) |
| Present Example | Mixture of $Zn_2SiO_4$:Mn and $YBO_3$:Tb (50 wt. % with respect to whole composition) | 105 | 95 (90) |

As is apparent from Table 3, the plasma display panel using the phosphors of Example of the present invention has higher luminance as compared with the plasma display panel using the phosphor of the prior art both at the initial operation and after 6000 hours operation.

As mentioned above, according to the present invention, by using the mixed green phosphor for the plasma display panel, it is possible to obtain the plasma display panel obtaining a stable discharge and having high luminance and long lifetime. Furthermore, it is possible to secure the same level of color purity of green as that of the CRT.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A plasma display panel comprising plural kinds of phosphor layers emitting different colors of fluorescent light, wherein a green phosphor layer is formed of a mixed green phosphor obtained by mixing a manganese activated zinc silicate phosphor represented by the general formula $Zn_2SiO_4$:Mn and having a surface potential with a negative polarity and a terbium activated rare earth borate green phosphor represented by the general formula $ReBO_3$:Tb, wherein Re denotes one rare earth element or a solid solution of plural kinds of rare earth elements selected from the group consisting of Sc, Y, La, Ce and Gd, having a surface potential with a positive polarity, and wherein the mixing ratio of the terbium activated rare earth borate green phosphor to the whole composition in the mixed phosphor is 10 to 75 weight %.

2. A plasma display panel comprising:

a pair of substrates positioned opposing each other with a discharge space provided therebetween wherein at least front substrate is transparent, a separation wall disposed on at least one substrate so as to divide the discharge space into several parts, display electrodes and data electrodes arranged on the front substrate and a back substrate, respectively, so that discharge is performed in the discharge spaces divided by the separation walls, and phosphor layers disposed so as to emit light by the discharge, wherein a green phosphor layer is formed of a mixed phosphor obtained by mixing a manganese activated zinc silicate green phosphor represented by the general formula $Zn_2SiO_4$:Mn and having surface potential with a negative polarity and a terbium activated rare earth borate green phosphor represented by the general formula $ReBO_3$:Tb, wherein Re denotes one rare earth element or a solid solution of plural kinds of rare earth elements selected from the group consisting of Sc, Y, La, Ce and Gd, having a surface potential with a positive polarity, and wherein the mixing ratio of the terbium activated rare earth borate green phosphor to the whole composition in the mixed phosphor is 10 to 75 weight %.

* * * * *